US006190782B1

(12) United States Patent
French

(10) Patent No.: US 6,190,782 B1
(45) Date of Patent: Feb. 20, 2001

(54) CORNER APPLIQUES FOR PANEL DOORS

(76) Inventor: Nicholas A. French, P.O. Box 40, Douglas, MI (US) 49406

( * ) Notice: Under 35 U.S.C. 154(b), the term of this patent shall be extended for 0 days.

(21) Appl. No.: 09/356,136

(22) Filed: Jul. 17, 1999

(51) Int. Cl.[7] ..... A47G 35/00

(52) U.S. Cl. ..... 428/542.2; 52/314; 52/316; 52/459; 52/471

(58) Field of Search ..... 52/316, 314, 470, 52/471, 417, 459, 455, 311.1, 311.2, 456, 457, 716.1; 428/542.2; 312/204

(56) References Cited

U.S. PATENT DOCUMENTS

Re. 17,510 * 12/1929 Hoegger .
99,930 * 2/1870 McGeary .
3,588,212 * 6/1971 Gersch .
5,675,952 * 10/1997 French .
5,884,444 * 3/1999 Harris .

* cited by examiner

*Primary Examiner*—Deborah Jones
*Assistant Examiner*—Wendy Boss
(74) *Attorney, Agent, or Firm*—Young & Basile, P.C.

(57) ABSTRACT

An applique used to conceal design limitations in panel doors as used on furniture and kitchen cabinets. The applique comprises of a body which permits its alignment with structural features found on panel doors in the area in and around the inside corner section of the door's panel section. With the application of the said appliques, the resultant is a workpiece comprising of a decorative element that enhances the overall character of the workpiece and also disguises either the joints between components which make-up a conventional door or the curved inside corners found on simulated raised panel doors.

8 Claims, 4 Drawing Sheets

CORNER APPLIQUES FOR PANEL DOORS

BACKGROUND OF INVENTION

This invention relates in general to new and useful improvements in panel doors as used on furniture and kitchen cabinets, and more particularly to the construction of such panel doors as it relates to the panel's inside corner.

It is well known the construction of conventional panel doors as shown in FIG. 1 and FIG. 2. The conventional panel door consists of a center panel 11 and four frame parts 12, 13, 14 and 15. Prior to assembling parts 11–15, various radii 16*a*, 16*b* and chamfers 16*c* are cut into the parts. The conventional panel door has a principal drawback. The door has a tendency for its parts to separate as a result of variations in its environment, such as temperature and/or humidity.

Simulated raised panel doors as shown in FIG. 3 are fabricated from a single sheet of material therefore having no parts to separation as the case with conventional doors. The simulated door is formed by machining the various radii and chamfers of the conventional door into the face of a single sheet of material, such as medium density fiberboard. The radii and chamfers are reproduced using various router bits also shown in FIG. 3. The disadvantage with the simulated door is in its appearance. Though it has a similar appearance to the conventional raised panel door, the exception is that the corners, of the panel section lack a square inside comer that result from the assembly of parts 11–15 of the conventional method. The inability to reproduce the square inside corners in the simulated method is the result of the use of router bits and particularly router bit 18 as shown in FIG. 3. Router bit 18 being of a cylindrical shape including a circumferential curved cutting blade 20 prohibits it from cutting a square inside corner. As shown in FIG. 4 the surface shape of router bit 18 leaves corner 22, a curved corner, the radius of which equals the radius of the router bit. One can overcome the affects of curved comers by using a router bit which comes to a point or a chisel. However, these techniques for producing square inside corners are expensive and time consuming.

Accordingly, it is the objective of the present invention to provide a means of overcoming the disadvantages found with both conventional and simulated panel doors, as well as to broaden the design limits of panel doors through the use of corner appliques.

REFERENCE NUMERALS IN DRAWINGS

11 center panel

12,13,14,&15 frame parts

16*a*, 16*b* radii

16*c* chamfers

18 router bit

20 circumferential curved cutting blade

22 curved corner

30, 32 applique members

34 radius

36 chamfer

38 relief

40 panel door

DESCRIPTION OF THE PREFERRED EMBODIMENTS

Figure 1:
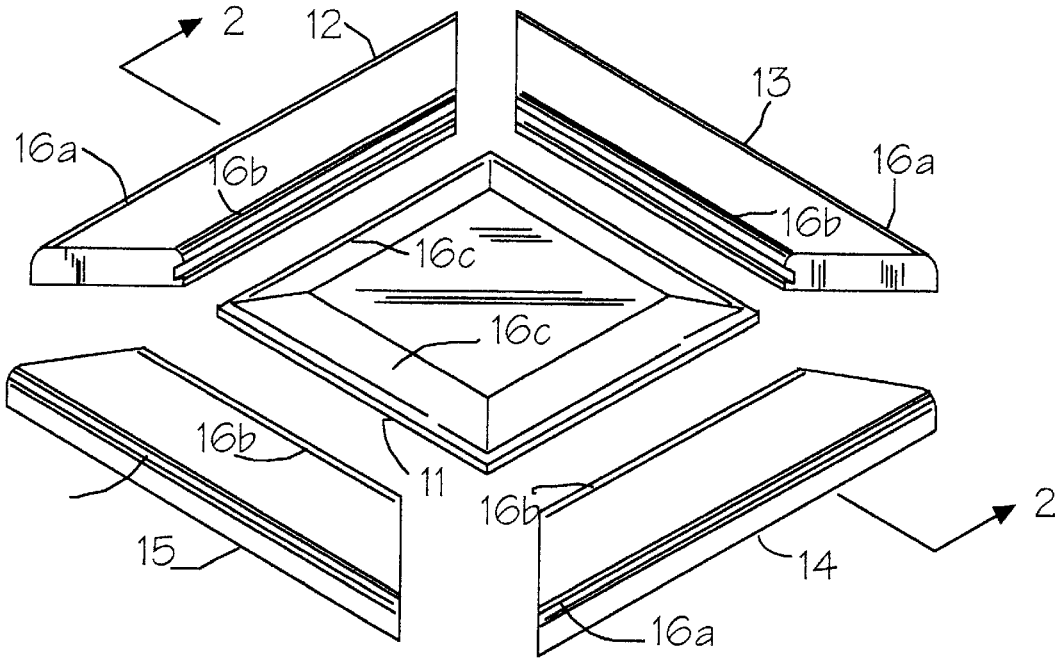
FIG. 1 Prior Art
FIG. 1 is an exploded perspective view of a conventional raised panel door.
Figure 2:
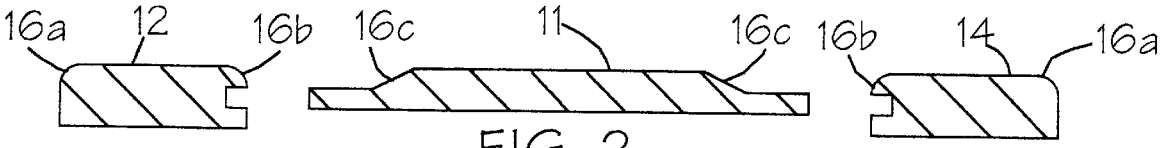
FIG. 2 Prior Art
FIG. 2 is a sectional view of the conventional door of FIG. 1 taken along the lines 2—2 of FIG. 1.
Figure 3:
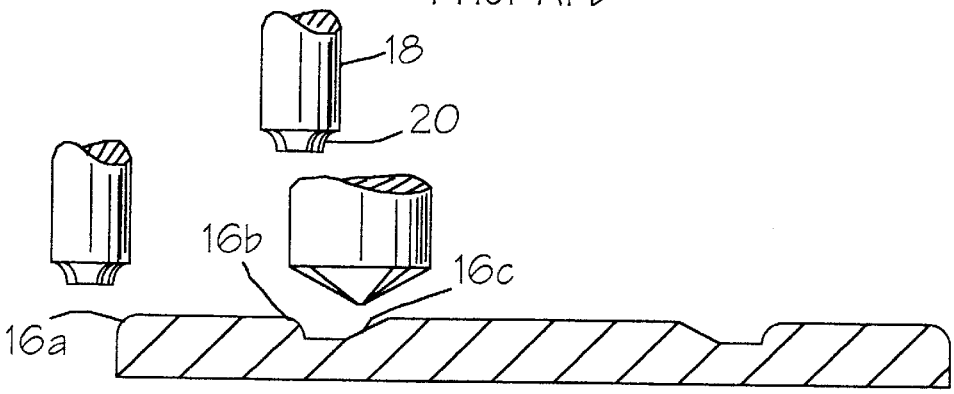
FIG. 3 Prior Art
FIG. 3 is a sectional view of a simulated door.
Figure 4:
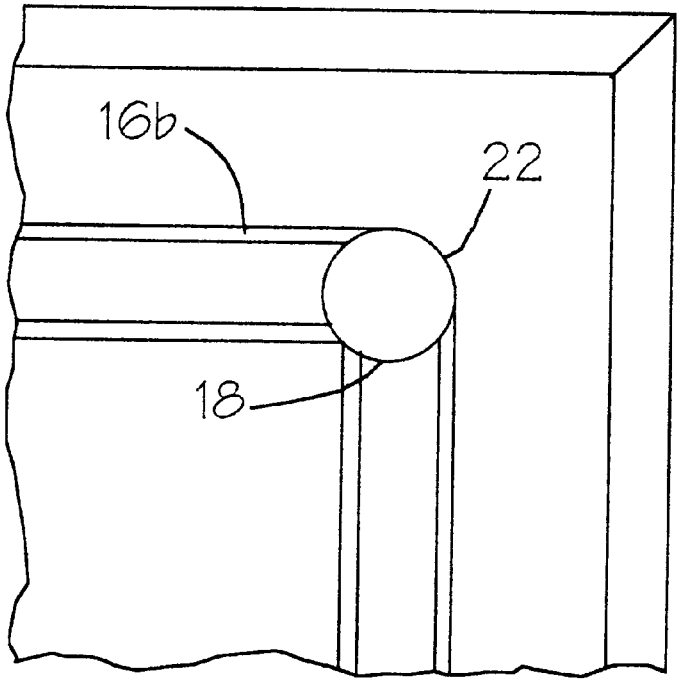
FIG. 4 Prior Art
FIG. 4 is a detail view of the simulated door of FIG. 3.
Figure 5:
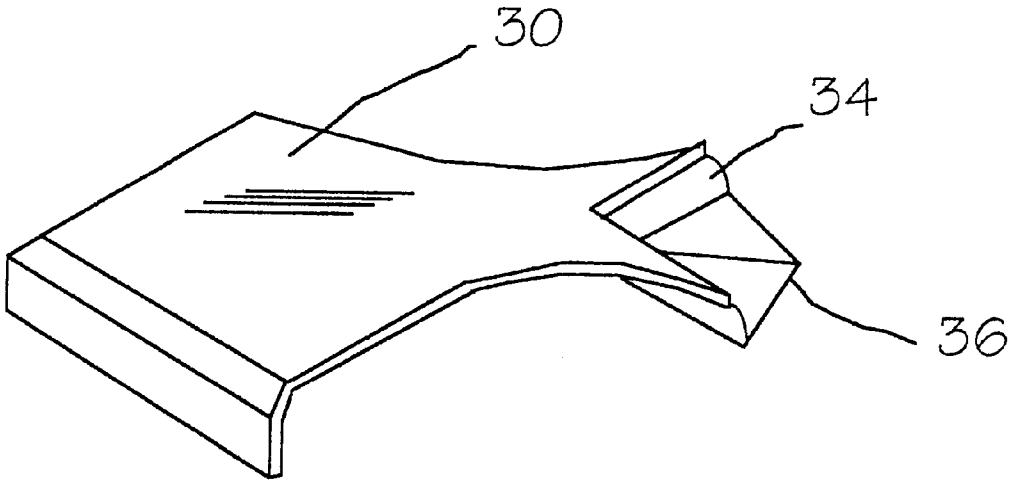
FIG. 5 and FIG. 6 are perspective views of members embodying the principles and concepts of the present invention.
Figure 6:
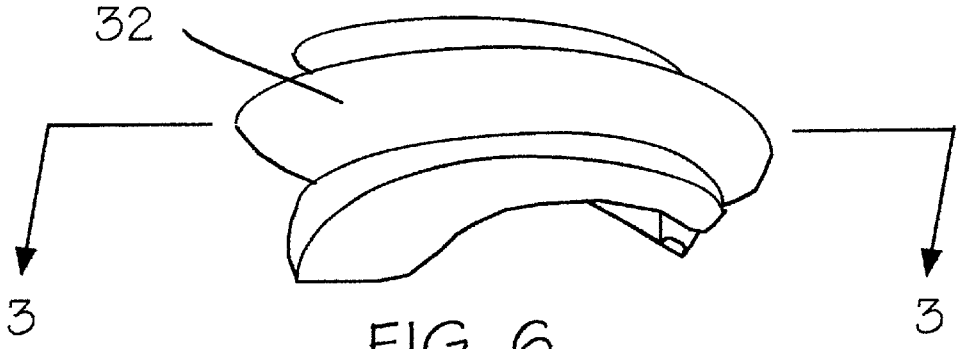
Figure 7:
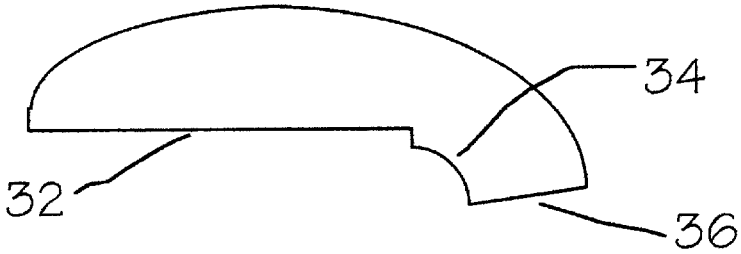
FIG. 7 is a sectional view of the present invention shown in FIG. 6 taken along the lines 3—3 of FIG. 6.

Referring to FIG. 5 and FIG. 6 there is shown applique members 30 and 32 comprising the present invention. Applique members 30 and 32 comprise of bodies which permits their alignment with the inside corner elements of panel doors. FIG. 7 is a sectional view of FIG. 6, taken along the lines 3—3 to illustrate the applique's design elements which permits its alignment with the panel door. When applied, applique members 30 and 32 cover the assemble joints of conventional doors or disguise the aesthetically displeasing radius corners of simulated doors.

Figure 8:
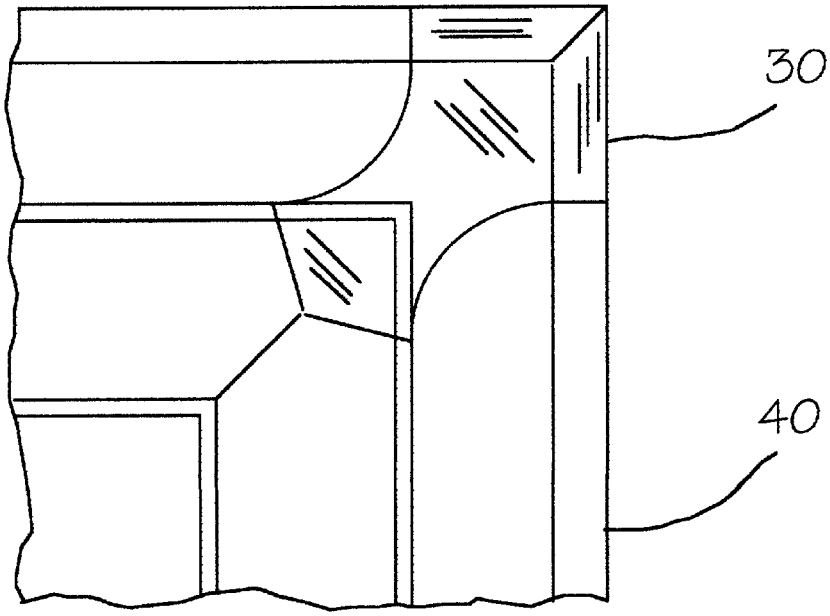
FIG. 8 is a detail view of a resulting door embodying the present invention as shown in FIG. 5.
Figure 9:
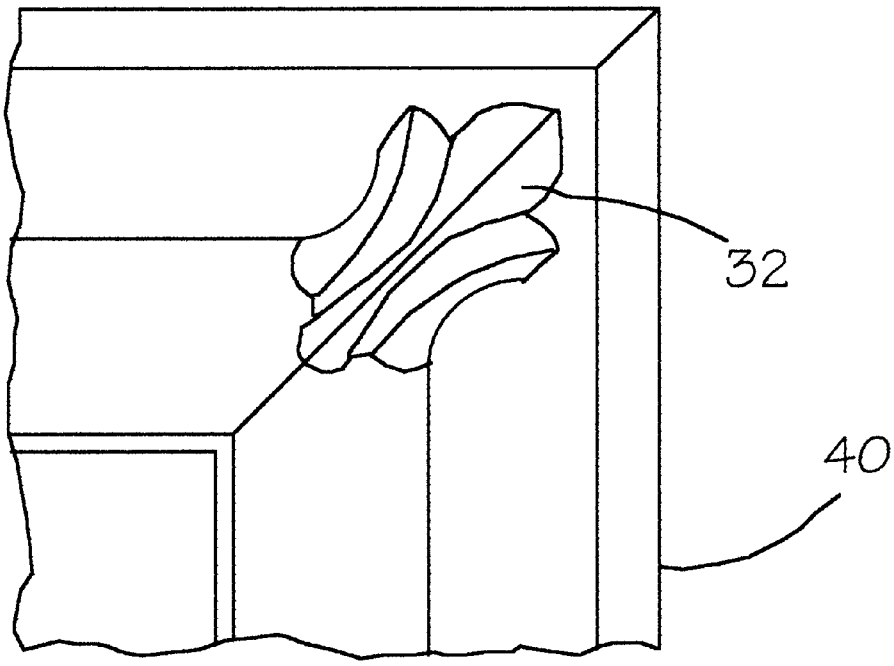
FIG. 9 is a detail view of a resulting, door embodying the present invention as shown in FIG. 6.

To form a panel door with the present invention, the applique is placed on a door so its body with such design elements as its radius 34 and chamfer 36 sections or similar elements align with the radius 16*b* and chamfer 16*c* sections or similar elements found on the door. The attachment of the applique can be performed with conventional fastening means such as adhesive or nails. The resultant, as shown in FIG. 8 and FIG. 9 is a workpiece comprising of a decorative component that enhances the overall character of the workpiece yet masks its undesirable features.

Figure 10:
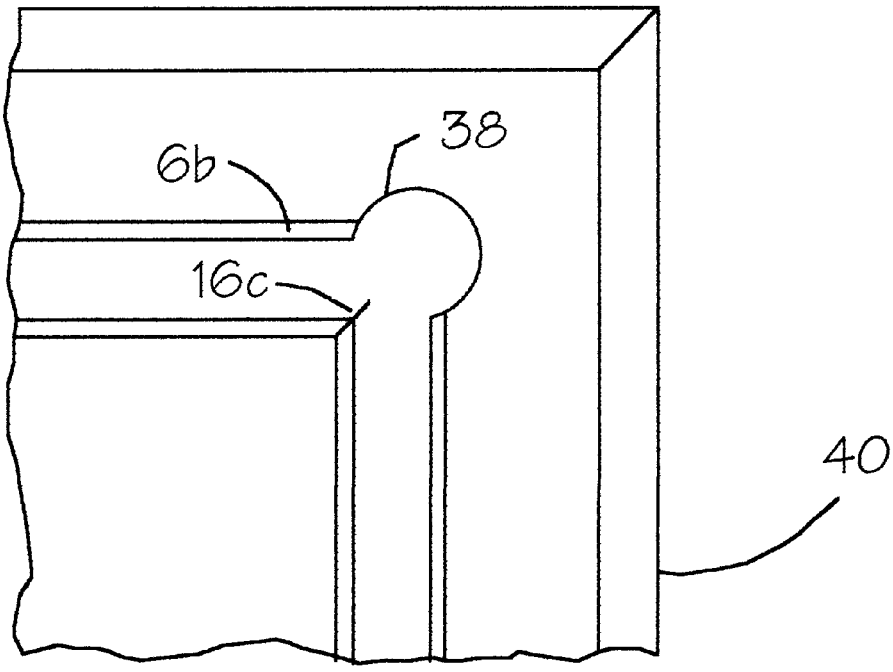
FIG. 10 is a detail view of the simulated door of FIG. 4 modified to accept the invention shown in FIG. 5.

Applique 30 can also be applied to a simulated door to produce the square inside corner appearance of a conventional door. To do so, a relief 38 as shown in FIG. 10 is formed into a simulated panel door 40 removing its curved inside corner by means of the simple wood working technique of end boring. Applique 30 is then placed into the relief 38 and is tapped into place and permanently affixed with an adhesive or mechanical fastener. Applying applique 30 to a simulated door provides for a cost effective means of producing the appearance of a square inside corner.

A door assembled with corner appliques can be covered with either a wet finish or a plastic film to produce a monolithic appearance.

The forming of corner applique members may be done in a separate operation to the wood door production through such conventional fabrication operations as plastic molding or metal stamping. Such techniques can produce corner appliques in high volume at low cost.

What is claimed is:

1. An applique for a surface of a panel door having planar and non-planar structural features outside corner sections, and at least one inside corner location said applique comprising:

a body shaped to align with the non-planar structural features of the panel door in the area in and around the inside comer location of said panel door.

2. The applique of claim 1, wherein said applique is fabricated from a plastic material.

3. The applique of claim 1, wherein at least a portion of the applique is configured to resemble an inside square comer of the panel door.

4. The applique of claim 3, wherein said applique is fabricated from a plastic material.

5. The applique of claim 1, wherein the structural features of the panel door includes a relief therein and the applique has a configuration including a first portion coinciding with the relief for insertion therein and another portion to extend around the relief.

6. The applique of claim 1, wherein the applique is affixed to the panel door by at least one of adhesive and mechanical fastener.

7. An applique for a surface of a panel door having planar and non-planar structural features and outside corner sections said applique comprising:

a body configured for alignment with the structural features of the door in the area in and around the outside corner sections of said door.

8. The applique of claim 7, wherein said applique is fabricated from a plastic material.

* * * * *